United States Patent [19]

Cook

[11] Patent Number: 4,498,537

[45] Date of Patent: Feb. 12, 1985

[54] PRODUCING WELL STIMULATION METHOD - COMBINATION OF THERMAL AND SOLVENT

[75] Inventor: Evin L. Cook, Dallas, Tex.

[73] Assignee: Mobil Oil Corporation, New York, N.Y.

[21] Appl. No.: 452,854

[22] Filed: Dec. 23, 1982

Related U.S. Application Data

[63] Continuation-in-part of Ser. No. 232,107, Feb. 6, 1981, abandoned.

[51] Int. Cl.[3] ..... E21B 43/243

[52] U.S. Cl. ..... 166/257; 166/261; 166/302

[58] Field of Search ..... 166/251, 256-262, 166/302, 303

[56] References Cited

U.S. PATENT DOCUMENTS

| | | | |
|---|---|---|---|
| 3,129,757 | 4/1964 | Sharp | 166/261 |
| 3,139,928 | 7/1964 | Broussard | 166/261 |
| 3,171,482 | 3/1965 | Simm | 166/261 |
| 3,174,543 | 3/1965 | Sharp | 166/256 |
| 3,316,962 | 5/1967 | Lange | 166/261 X |
| 3,376,929 | 4/1968 | Hagedorn | 166/261 |
| 3,409,083 | 11/1968 | Prats | 166/256 |
| 3,465,822 | 9/1969 | Klein | 166/256 |
| 3,680,633 | 8/1972 | Bennett | 166/256 |
| 3,978,925 | 9/1976 | Redford | 166/261 |
| 4,026,357 | 5/1977 | Redford | 166/261 |
| 4,089,372 | 5/1978 | Terry | 166/261 X |
| 4,427,066 | 1/1984 | Cook | 166/261 |

*Primary Examiner*—George A. Suchfield

*Attorney, Agent, or Firm*—Alexander J. McKillop; Michael G. Gilman; Stanislaus Aksman

[57] ABSTRACT

A method for the cyclic thermal stimulation of heavy oil adjacent producing wells to increase recovery of the oil produced therefrom by using an in-situ combustion process wherein oxygen or a fluid containing a minimum of about 75% by volume pure oxygen is injected into the well as the oxidizing medium, igniting the oil in the reservoir around the producing well so as to produce a combustion zone and to generate combustion gases consisting essentially of carbon dioxide and water in the form of steam, continuing injection of the oxygen until the combustion zone has propagated radially a distance of about 5 to 50 feet from the producing well, and thereafter recovering oil from the well. After terminating combustion, the well may be shut in for a period of time to allow the carbon dioxide and heat generated to more effectively permeate the reservoir adjacent the well prior to being returned to production status. The carbon dioxide dissolves in the oil reducing its viscosity along with the viscosity decrease resulting from the heat generated in the reservoir by combustion so that when the well is opened for production there is an improved flow of oil. The process of the invention applies to a single well or a plurality of wells spaced apart in a selected pattern with the various phases of the process cycles operated successively on the various wells in the pattern in any selected sequence.

19 Claims, 2 Drawing Figures

PRODUCING WELL STIMULATION METHOD - COMBINATION OF THERMAL AND SOLVENT

This application is a continuation-in-part of application Ser. No. 232,107, filed Feb. 6, 1981, now abandoned.

BACKGROUND OF THE INVENTION

1. Field of the Invention

This invention relates to an in-situ combustion process for the cyclic thermal stimulation of heavy oil around a producing well wherein oxygen or a fluid containing a minimum of about 75% by volume pure oxygen is used as the oxidant so as to react with the oil to release heat of combustion and to produce high concentrations of carbon dioxide. The increased temperature, pressure, and the dissolution of the $CO_2$ in the reservoir oil reduces its viscosity and thereby increases oil production from the well when it is returned to production.

2. Description of the Prior Art

Repetitive stimulation of oil producing wells is a production practice of long standing. The phrase "cyclic stimulation" is often used to reflect anticipated production rate increases, the duration of which is relatively short as compared to the total life of the well. The cause of the production increase arises from either (1) an increase in pressure driving reservoir fluids toward the producing well, or (2) a decrease in resistance to flow of the fluids such as reduction in viscosity or removal of impediments to flow in the reservoir rock surrounding the well. The viscosity reduction may be achieved through use of a low viscosity fluid solvent and by increasing the temperature of the reservoir fluids and rock in the proximity of the reservoir.

In wells producing heavy (viscous) oil, cyclic thermal stimulation has become widespread in use. Two somewhat different thermal stimulation techniques have been developed: (1) cyclic steam injection, and (2) cyclic in-situ combustion. A typical cyclic steam stimulation may include: (1) injection of steam into a producing interval for a period that may extend up to several weeks, depending on thickness of the reservoir, well spacing, rate of steam injection, etc.; (2) allowing a "soak" period (which in some circumstances is not necessary); and (3) returning the well to production. The heat introduced into the reservoir rock continues to be effective for some time in warming and reducing the viscosity of the oil, thus increasing the production rate. The effects of the stimulation will decline over a period of a few months whereupon the treatment may be repeated.

Instead of using fuel-fed steam generators, cyclic in-situ combustion may be used to heat the reservoir. With this technique, air is injected into the reservoir through the producing well, which, after ignition, burns a small portion of the crude oil "in-situ", generating heat which is conveyed outward from the well into the surrounding reservoir by the flue gas formed and by vaporized crude oil and water. Water may be injected along with, intermittently, or following air injection to form steam and hot water which will convey the released heat of combustion farther into the reservoir. Although this method of stimulation may utilize fuel of less value than the steam process, wherein the steam is generated prior to injection into the reservoir, use of the latter process is generally favored. One major disadvantage of the combustion method is the requirement of compressing to injection pressure approximately four mols of nitrogen for every single mol of oxygen in air to support the combustion reaction. This increases cost and also dilutes the carbon dioxide concentration in the flue gas, greatly diminishing its efficacy as a solvent gas for reducing viscosity of the heavy oil.

The method of this invention is a major improvement in the combustion stimulation technique in that it uses oxygen or a fluid containing a minimum of about 75% by volume pure oxygen as the oxidant injected into the reservoir through the production well. The cycle of the process would be similar to that used with air: i.e., (1) inject the oxidant, which after ignition causes movement of a burn front through the reservoir rock surrounding the well; (2) allow a "soak" period (which is optional); and (3) return the well to production. The latter step usually requires installation of a downhole pump to remove produced liquids from the well.

The advantages resulting from the use of oxygen or a fluid containing a minimum of about 75% by volume pure oxygen include:

1. Elimination of large amounts of "inert" gas, i.e., nitrogen, which is costly to compress for injection. Also the presence of the inert nitrogen gas as a separate phase in the pores of the reservoir rock impedes the flow of oil toward the well.

2. The concentration (and partial pressure) of the $CO_2$ formed in the combustion reaction is increased, and correspondingly its solubility in the heavy oil is increased. As a result, the viscosity of the heavy oil containing larger amounts of solvent gas is substantially reduced, and oil production rate is increased accordingly.

3. The increased $CO_2$ content in the oil phase increases the extent to which the "solution gas drive" can contribute to the displacement of oil toward the production well.

4. Ignition of the combustion reaction in-situ is facilitated by the higher oxygen concentration of the injected gas. "Auto-ignition" will occur with a greater number of crude oils, thus reducing the need to use downhole burners, electric heaters, or steam preheating to start the combustion reaction. (This does not preclude the use of any of these methods where the crude oil properties do not favor auto ignition.)

5. Water injection along with or intermittent to the injected oxidant may be used as in "wet combustion" using air and water. The advantages of increased heat transport farther into the reservoir by the steam formed in-situ from heat released by the combustion reaction also apply with oxygen or enriched air combustion. The increased solubility of $CO_2$ in the condensed water also enhances its expulsion from the reservoir to the producing well which also enhances the displacement of the heavy oil toward the producing well.

In U.S. Pat. No. 3,174,543 to Sharp there is described a method of recovering oil by producing carbon dioxide in the reservoir region surrounding an injection well by in-situ combustion and then introducing water into the reservoir to drive the carbon dioxide through the reservoir to displace the reservoir oil toward a production well. The present process is an in-situ combustion stimulation process that takes place in the reservoir immediately surrounding the bottom of a producing well using oxygen or a fluid containing a minimum of about 75% by volume pure oxygen as the oxidizing medium which results in the formation of a combustion gas comprising a high concentration of carbon dioxide. The carbon dioxide readily dissolves in the oil and reduces its viscosity. The heat generated in the reservoir by combustion also reduces the viscosity of the oil phase thus improving its flow through the formation when production is resumed. By the process of this invention therefore, a more effective recovery of the heavy crude oil is obtained.

Thermal oil stimulation processes using the so-called "huff-n-puff" gas injection techniques are disclosed in U.S. Pat. Nos. 3,332,482 to Trantham, 3,369,604 to Black et al. and 3,465,822 to Klein.

U.S. Patent to Trantham, 3,332,482, discloses a process for the secondary recovery of viscous oil using an in-situ combustion process at the bottom of a producing well in which air is used as the oxidizing medium. In this process, air is injected into the production well and the oil surrounding the bottom of the well is ignited to establish a combustion zone. Combustion is continued until the reservoir is plugged by viscous oil which results in a substantial increase in pressure. Combustion is terminated and the well is opened for production so that the compressed gases within the reservoir remote from the production well and beyond the plugged area drive the oil into the hot burned-out area between the plugged area and the production well where it is heated, perhaps upgraded somewhat, and finally recovered through the production well. Inherent in this process is the production of a gas, which is normally referred to as flue gas, which gas is composed predominantly of nitrogen and lesser amounts of carbon dioxide, carbon monoxide and other gases derived from the crude oil. The carbon dioxide in the flue gas is diluted by the nitrogen and other gases and is much less soluble in the reservoir oil than a gas consisting of substantially pure carbon dioxide or a gas containing a higher concentration of carbon dioxide than the flue gas produced by the use of air as the oxidizing medium. The solubility in reservoir oil of carbon dioxide formed with air combustion, at a given pressure, may be five to ten times less than that formed from oxygen combustion.

U.S. Pat. No. 3,369,604 discloses a method for stimulating producing wells using a combination of steam stimulation and in-situ combustion wherein air, or a mixture of air and oxygen is used as the oxidizing gas.

U.S. Pat. No. 3,465,822 to Klein, discloses a thermal oil stimulation process in which in-situ combustion is initiated around a well by air injection followed by injection of water and injection of inert gas, sequentially, and thereafter opening up the well to flow of fluids, including oil.

Also, in a Society of Petroleum Engineer of AIME article, SPE 9228, presented on Sept. 23–26, 1979, in Las Vegas, Nev., entitled "A Parametric Study of the $CO_2$ HUF-n-PUF Process" there is disclosed the results of Mathematical Model studies of the use of carbon dioxide as a solvent gas in cyclic well stimulation. The carbon dioxide is not prepared in the well by in-situ combustion as in the present process and offers no advantages associated with the heat generated by oxygen combustion of the reservoir oil.

None of the prior art discloses the improved method of recovering oil around a well using in-situ combustion stimulation wherein the oxidizing medium is oxygen or a fluid containing a minimum of about 75% by volume pure oxygen so as to produce increased concentrations (and partial pressures) of carbon dioxide in the combustion gases. The carbon dioxide dissolves in the reservoir oil reducing its viscosity, thereby facilitating its flow to the production. The viscosity of the reservoir oil is further reduced by the heat generated in the reservoir by combustion.

SUMMARY OF THE INVENTION

This invention is directed toward a method for the cyclic thermal stimulation of heavy oil producing wells by in-situ combustion around the producing well using oxygen or a fluid containing a minimum of about 75% by volume pure oxygen as the oxidizing medium which results in improved recovery of the oil from the reservoir. The oxygen is produced from air on the earth's surface near the producing wells by means of a cryogenic unit. The use of such an oxidizing medium comprising oxygen or at least 75 vol. % oxygen produces a combustion gas comprising high concentrations of carbon dioxide and water in the form of steam. The steam aids in carrying heat farther into the reservoir, and the carbon dioxide is an effective solvent in that it dissolves in the heavy oil at even greater distances in the reservoir beyond the combustion zone and steam heated zone thereby reducing its viscosity. During combustion, the heat generated is absorbed by the reservoir which extends radially from the production well resulting in further reduction of the viscosity of the heated heavy oil as it subsequently flows toward the producing well. Combustion may be continued until the combustion zone travels a radial distance in the range of about 5 to 50 feet from the production well, after which in-situ combustion is terminated and the well is opened to production whereby fluids including oil are recovered from the reservoir. In addition, when combustion has been carried out in the stated portion of the reservoir, the production well may be shut-in for a predetermined interval of time to enhance the solvent effect of the carbon dioxide and the thermal effect of combustion. The length of this soak period will depend upon the field characteristics of the producing well. Water may also be mixed with the oxidant to enhance the transport of heat farther into the reservoir thereby increasing the effectiveness of the thermal effects. The various steps of the process may be repeated for a plurality of cycles until the recovery of oil is unfavorable.

The various phases of the process cycle may be operated successively on a plurality of spaced-apart wells in any selected position in any sequence. When the first well is on in-situ combustion, one (or more) of the adjacent wells is prepared for ignition so that it is ready for the in-situ combustion phase of the process when the first well is put on production following termination of the in-situ combustion phase. The various phases of the process may be repeated in each well for a plurality of cycles.

DESCRIPTION OF THE PREFERRED EMBODIMENT

Figures 1, 2:
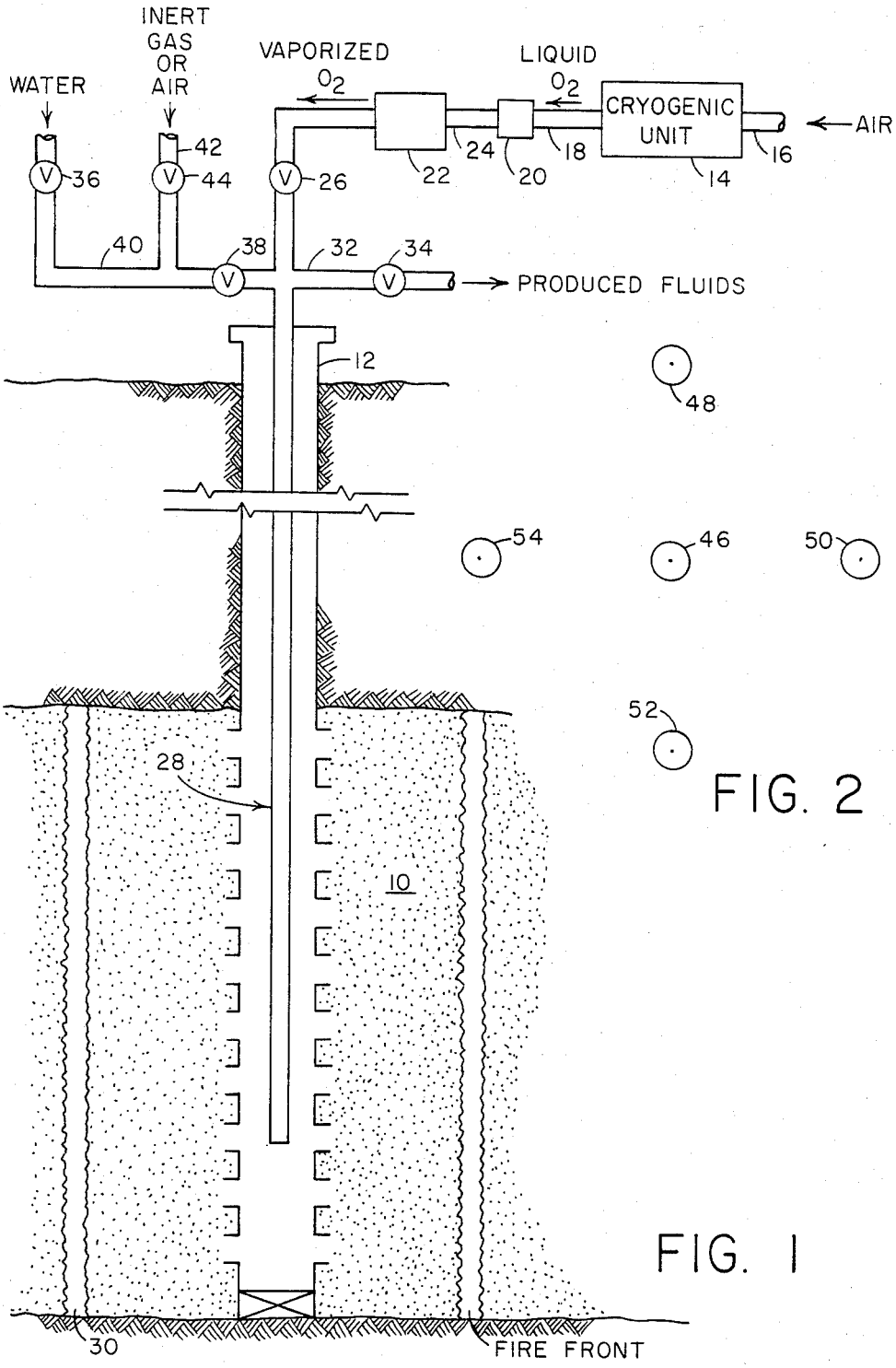
FIG. 1 illustrates the method used in the invention.
FIG. 2 illustrates one arrangement of wells in which the invention is applicable.

In accordance with the present invention, oil is recovered from a reservoir by cyclic thermal stimulation of one or more producing wells using an in-situ combustion process wherein oxygen is used as the oxidizing fluid instead of air. Although the preferred oxidizing fluid is pure oxygen, some sacrifice in the actual performance of the process may be needed to make it more practical and economically feasible and therefore the oxidizing fluid may contain a minimum of about 75% by volume pure oxygen. The oxygen, upon reacting with the hydrocarbons in the reservoir, yields principally gaseous carbon dioxide and water as follows:

$$(CH_n)_m + \left(m + \frac{mn}{4}\right) O_2 \longrightarrow m\,CO_2 + \frac{mn}{2} H_2O \quad (1)$$

The carbon dioxide acts as a solvent since it will dissolve in the reservoir oils and therefore appreciably lower the viscosity of the oil even in the absence of the thermal effects. The amount of dissolution will depend on the local reservoir pressure and temperature, but will be substantially greater than that experienced if air is used because of the higher concentration of carbon dioxide. The water formed will be initially in the form of steam which will aid in conveying the heat of combustion farther into the reservoir, enhancing the effect of the heat released.

By using oxygen or a fluid containing a minimum of about 75% by volume pure oxygen as the oxidizing medium, the large amount of nitrogen introduced into the well when air is used would be eliminated, along with the deleterious effect of gas phase nitrogen on the permeability of the liquid oil phase. Water injection along with the oxidizing medium after combustion is initiated may be used to moderate the high temperature generated and to obtain greater distances of penetration into the reservoir for more effective heat distribution. It would not necessarily add gaseous products to be subsequently produced.

For the purpose of simplicity in describing the invention, reference sometimes will be made herein to only one production well in my in-situ combination stimulation process. However, it will be recognized that in practical application of the invention, a plurality of such wells may be used and in most cases will be utilized.

In carrying out this invention, an oxidizing gas comprising oxygen or a fluid containing a minimum of about 75% by volume pure oxygen is injected into a producing well and combustion is initiated in any suitable conventional manner such as by locating an electrical or gas-fired heater within the well so as to initiate a combustion zone around the well and generate combustion gases consisting principally of carbon dioxide and water in the form of steam. Continued injection of oxygen moves the resulting combustion zone outward into the reservoir and the carbon dioxide in the combustion gases dissolves in the reservoir oil reducing its viscosity. The heat generated by combustion also lowers the viscosity of the reservoir oil surrounding the production well and the steam aids in conveying the heat of combustion farther into the reservoir.

Combustion is continued through the reservoir around the production well until the combustion zone advances a radial distance of about 5 to 50 feet from the production well. Combustion is then terminated and the production well is returned to a producing operation.

An alternative method of carrying out the invention is to shut in the production well after the combustion zone has moved a radial distance of about 5 to 50 feet from the production well to allow a soak period in which heat generated in the reservoir will distribute itself and also allow the carbon dioxide to more effectively dissolve in the heavy oil at greater distances from the well thereby lowering its viscosity. For optimum results, the length of the soak period will vary depending upon the characteristics of the producing well such as depth, rate of production, frequency of stimulation periods and size of stimulate treatment. After the soak period is terminated, the well is then returned to producing operation.

Another embodiment of this process is to inject water continuously or periodically with the oxidizing fluid in the production well after combustion is initiated which serves to obtain greater distance of penetration of combustion heat into the reservoir for more effective heat distribution. The water serves to recuperate the heat stored in the burned-out reservoir, which would otherwise be tested. This heat is then used to evaporate water. The steam thus formed condenses downstream of the combustion zone, where it contributes to further heating of the reservoir. This technique is known as wet combustion. As another variation, a predetermined amount of water may be injected after oxygen injection has been terminated whereupon the water is converted into steam by scavenging heat from the high temperature zone created by combustion thereby extending the distance into the reservoir that is benefited by the heat of combustion.

The substantial concentration of carbon dioxide produced in the reservoir in-situ acts as a local pressurizing agent, a solvent in the oil phase lowering the viscosity of the oil, and together with the thermal effects of combustion stimulates the reservoir and significantly increases the production rate of the oil.

The oxygen used may be obtained from any type of separation plant capable of providing the desired purity. A highly expedient approach is to inject oxygen into the production well that may be supplied from cryogenic units from which the oxygen in liquid phase is pumped at any desired pressure level and thereafter passes through a heat exchanger to vaporize the high pressure liquid oxygen. This eliminates the need for compressor and attendant equipment. The cryogenic units may be portable and operated at the well site. Equally effective is use of oxygen available in the gaseous phase which may be compressed with gas compression equipment to the pressure level desired for injection into a well.

The sequence of the process steps including in-situ combustion, reservoir soak period, injection of water to propagate heat further into the reservoir followed by production may be repeated in each well for a plurality of cycles until further recovery of oil is unfavorable.

The process of my invention may be best understood by referring to FIG. 1, in which an oil-containing reservoir 10 is penetrated by a production well 12 in fluid communication with the entire thickness of the reservoir by means of perforations. On the surface, a cryogenic unit 14 for producing liquid oxygen from air is positioned near the production well 12. Air is introduced into the cryogenic unit 14 through line 16 and the cryogenic unit is operated to produce substantially pure liquid oxygen. A suitable cryogenic unit is the one disclosed in an article by K. B. Wilson entitled "Nitrogen Use In EOR Requires Attention to Potential Hazards", Oil & Gas Journal, Vol. 80, No. 42, pp. 105–109, 1982, the disclosure of which is hereby incorporated by reference. Liquid oxygen produced by cryogenic unit 14 flows through line 18 and is pumped by cryogenic pump 20 through a heat exchanger 22 via line 24 to vaporize the liquid oxygen. The need to use a compressor conventionally used in an in-situ combustion operation is eliminated thereby reducing the hazards associated with large scale mechanical compressors and also reducing energy costs for compression. Vaporized oxygen at a predetermined pressure is introduced into the reservoir 10 through open valve 26 and tubing 28 and the oil in the reservoir is ignited either by autoignition or by any suitable conventional manner such as chemical igniters or heaters. For example, an electric heater (not shown) may be positioned in well 12 adjacent the perforations establishing communication with the oil-containing reservoir 10. The heater is an electric heater capable of heating a portion of the reservoir immediately adjacent to the production well 12 to a temperature sufficient with the oxygen flowing into the well to result in ignition of the hydrocarbons in the reservoir 10. The oxygen reacts in the reservoir with the hydrocarbons to yield principally gaseous carbon dioxide and water in accordance with equation (1) described above. Injection of substantially pure oxygen is continued and the resulting combustion front 30 advances radially through the formation from the well. The heat emitted from the in-situ combustion operation lowers the viscosity of the oil and the generated carbon dioxide dissolves in the oil also lowering its viscosity.

After the combustion front 30 has advanced a predetermined distance from the production well, preferably 5 to 50 feet, injection of oxygen is discontinued and the in-situ combustion operation is terminated. Thereafter, the valve 26 in tubing 28 is closed and fluids including oil are produced through line 32 and opened valve 34. The pressure built up in the reservoir 10, particularly the pressure beyond the combustion zone 30 forces heavy oil reduced in viscosity by heat and dissolved $CO_2$ into the hot burned-over area behind the combustion zone so that the mobilized oil passes into production well 12 from which it is produced thru production line 32. If desired, after the combustion zone 30 has advanced the desired distance from the production well 12 the reservoir 10 is allowed to undergo a soak period for a predetermined period of time to allow the heat generated to distribute itself and also allow the carbon dioxide to more effectively dissolve in the oil thereby lowering its viscosity. After the soak period, the well is returned to production.

Optionally, after in-situ combustion has been established in the reservoir 10, valves 36 and 38 are opened and water via line 40 is introduced into tubing 28 where it is mixed with the oxygen from cryogenic pump 20. The water may be periodically injected along with the oxygen.

If it is desired to reduce the oxygen concentration of the injected gas to a predetermined value of at least 75 vol. %, air or an inert gas such as nitrogen or carbon dioxide or mixtures thereof is transported via line 42 through open valve 44, line 40 and open valve 38 into tubing 28 where it is comingled with the oxygen from cryogenic pump 20.

Although the mixture has been described in terms of stimulating a single production well, another embodiment of the invention is to conduct the in-situ combustion and recovery process in several wells successively. A plurality of wells in any selected pattern are operated in the manner described one after another. The well pattern may be arranged according to any patterns as illustrated in U.S. Pat. No. 3,927,716 to Burdyn et al. In this embodiment, while the first well is on in-situ combustion, one (or more) of the other wells is prepared for ignition so that it is ready for the in-situ combustion phase of the process when the oxidizing fluid is cut off from the first well.

FIG. 2 illustrates one arrangement of wells to which the invention is applicable. Central well 46 is surrounded by ring wells 48, 50, 52 and 54. Each well penetrates the oil-containing reservoir and is in fluid communication with a substantial portion of the reservoir.

In operation with the well arrangement shown in FIG. 2, an in-situ combustion operation is effected in the reservoir surrounding well 46 in accordance with the process as previously described and the other wells are shut in. After in-situ combustion has been continued for a predetermined period of time in well 46, in-situ combustion is terminated and well 46 is converted to production. At this point, an in-situ combustion operation is effected in one or more of the other wells 48, 50, 52 and 54 for a predetermined period of time. The various phases of the process cycle are operated successively on the various wells in the pattern in any selected sequence. The process may be repeated in each well for a plurality of cycles until oil production response is unfavorable.

From the foregoing specification one skilled in the art can readily ascertain the essential feature of this invention and without departing from the spirit and scope thereof can adopt it to various diverse applications.

What is claimed is:

1. A method for stimulating the recovery of oil from a subterranean reservoir having a relatively heavy crude oil, into which has been drilled at least one production well which comprises the steps of:

(a) injecting a fluid containing at least 75% by volume of oxygen into said reservoir through said production well to initiate an in-situ combustion zone containing a high concentration of carbon dioxide in the vicinity of said production well;

(b) continuing to inject said fluid to propagate said combustion zone into said reservoir a radial distance of about 5 to 50 feet from said production well thereby reducing the viscosity of the reservoir oil by the heat generated from in-situ combustion and the in-situ produced carbon dioxide dissolving in the reservoir oil;

(c) terminating the flow of said fluid into said reservoir; and (d) recovering oil from said production well.

2. The method of claim 1 further including, after step (c), but before step (d), the step of injecting a predetermined amount of water into said reservoir through said production well to reduce the temperature of the reservoir, form a substantial amount of steam, and drive reservoir heat more remote from said well.

3. The method of claim 1 further including the step of shutting-in the production well for a predetermined time interval after step (c).

4. The method of claim 3 wherein said fluid contains a diluting gas selected from the group consisting of air, an inert gas and mixtures thereof.

5. The method of claim 4 wherein said inert gas is nitrogen.

6. The method of claim 4 wherein said inert gas is carbon dioxide.

7. The method of claim 1 further including repeating steps (a) to (d) for a plurality of cycles until the recovery of oil is unfavorable.

8. The method of claim 7 wherein said fluid is a vaporized pure oxygen produced by cryogenic separation of air into liquid nitrogen and liquid oxygen, and subsequently vaporizing said liquid oxygen.

9. A method for recovering heavy oil from a subterranean, heavy oil-containing reservoir penetrated by a plurality of wells, at least one of said wells being a production well, comprising the steps of:

(a) injecting a fluid containing at least 75% by volume of oxygen into said reservoir through said production well to initiate an in-situ combustion zone containing a high concentration of carbon dioxide in the vicinity of said production well;

(b) continuing to inject said fluid for a predetermined period of time thereby advancing the combustion zone radially from said well and reducing the viscosity of the reservoir oil by the heat generated by in-situ combustion and the in-situ produced carbon dioxide dissolving in the reservoir oil;

(c) terminating the flow of said fluid into said reservoir;

(d) recovering oil from said production well; and (e) applying steps (a) through (d) to said reservoir successively through a plurality of said wells whereby when the first of said wells is in the phase of steps (c) and (d), the second of said wells is in the phase of steps (a) and (b).

10. The method of claim 9 further including after step (c) the (d) step of injecting a predetermined amount of water into said reservoir via said well to reduce the temperature of the reservoir, form a substantial amount of steam, and drive reservoir heat more remote from said well.

11. The method of claim 9 further including the step of shutting-in said well for a predetermined time interval after step (c).

12. The method of claim 9 further including repeating steps (a) through (d) through each of said wells for a plurality of cycles until the recovery of additional oil from each well is unfavorable.

13. The method of claim 12 wherein said fluid is a vaporized pure oxygen produced by cryogenic separation of air into liquid nitrogen and liquid oxygen, and subsequently vaporizing said liquid oxygen.

14. A method for stimulating the recovery of oil from a subterranean reservoir having a relatively heavy crude oil, into which has been drilled at least one production well which comprises the steps of:

(a) injecting a first fluid containing at least 75% by volume of oxygen into said reservoir through said production well to initiate an in-situ combustion zone containing a high concentration of carbon dioxide in the vicinity of said production well;

(b) injecting a second fluid consisting essentially of water into said reservoir through said production well;

(c) continuing to inject said first and second fluids to propagate said combustion zone into said reservoir a radial distance of about 5 to 50 feet from said production well, thereby reducing the viscosity of the reservoir oil by the heat generated from in-situ combustion and the in-situ produced carbon dioxide dissolving in the reservoir oil;

(d) terminating the flow of both of said fluids into said reservoir; and (e) recovering oil from said production well.

15. The method of claim 14 wherein said second fluid is injected continuously and simultaneously with said first fluid.

16. The method of claim 15 further including, after step (d) but before step (e), the step of injecting a predetermined amount of a third fluid consisting essentially of water into said reservoir through said production well to reduce the temperature of the reservoir, form a substantial amount of steam, and drive reservoir heat more remote from said well.

17. The method of claim 16 further consisting essentially of the step of shutting-in the production well for a predetermined time interval after step (d).

18. The method of claim 17 further consisting essentially of repeating steps (a) to (e) for a plurality of cycles until the recovery of oil is unfavorable.

19. The method of claim 14 wherein said second fluid is injected periodically with said first fluid.

* * * * *

UNITED STATES PATENT AND TRADEMARK OFFICE

CERTIFICATE OF CORRECTION

PATENT NO. : 4,498,537

DATED : February 12, 1985

INVENTOR(S) : EVIN LEE COOK

It is certified that error appears in the above-identified patent and that said Letters Patent is hereby corrected as shown below:

| | |
|---|---|
| Column 8, line 55 (Claim 3, line 1): | delete "1" and insert --2-- therefor. |
| Column 8, line 65 (Claim 7, line 1): | delete "1" and insert --4-- therefor. |
| Column 9, line 29 (Claim 10, line 2): | delete "(c) the (d)" and insert --(c), but before step (d)-- therefor. |
| Column 9, line 41 (Claim 13, line 2): | delete "vaporized" and insert --substantially-- therefor. |
| Column 10, lines 1 & 2 : (Claim 13, lines 3 & 4) | delete "into liquid nitrogen and liquid oxygen, and subsequently vaporizing said liquid oxygen". |

Signed and Sealed this

*Twenty-seventh* Day of *August 1985*

[SEAL]

*Attest:*

DONALD J. QUIGG

*Attesting Officer*

*Acting Commissioner of Patents and Trademarks*